US006062141A

United States Patent [19]

Betts

[11] Patent Number: 6,062,141

[45] Date of Patent: May 16, 2000

[54] OMNI-DIRECTIONAL DETONATOR

[75] Inventor: Robert E. Betts, Huntsville, Ala.

[73] Assignee: The United States of America as represented by the Secretary of the Army, Washington, D.C.

[21] Appl. No.: 09/188,113

[22] Filed: Nov. 9, 1998

[51] Int. Cl.[7] ..... F42B 3/10

[52] U.S. Cl. ..... 102/202.5

[58] Field of Search ..... 102/202, 202.14, 102/202.5, 202.7, 202.8, 202.9, 204, 205

[56] References Cited

U.S. PATENT DOCUMENTS

| | | | |
|---|---|---|---|
| 734,966 | 7/1903 | Schou | 102/202 |
| 3,392,673 | 7/1968 | King | 102/202 |
| 3,434,426 | 3/1969 | De Dapper | 102/202 |
| 3,667,396 | 6/1972 | Barrett | 102/101 |
| 4,727,808 | 3/1988 | Wang et al. | 102/202.5 |
| 4,896,609 | 1/1990 | Betts et al. | 102/309 |
| 5,044,282 | 9/1991 | Fuch et al. | 102/475 |

*Primary Examiner*—Thomas Price

*Attorney, Agent, or Firm*—Arthur H. Tischer; Howard G. Garner; Freddie M. Bush

[57] ABSTRACT

A donor charge detonator is disclosed which has a donor charge case for containing a main explosive with means for initiating the main charge of explosive. The case design comprises a plurality of flutes formed around the outer surface of the case, and the plurality of flutes comprise valley members or grooves separated by peaks between successive grooves. The grooves and peaks of the flutes function after initiation of the main charge of explosive to cause the formation of particles from the donor charge case and the resulting explosive force to follow along the valleys of the flutes thereby forming a plurality of jets similar to linerar lines whereby the resulant shock is enhanced in a specific direction. The resulting force and the resultant shock are transferred at a higher magnitude because of the jet effect of the fluted configuration of the donor charge case. The specific direction is directed to a point on an explosive acceptor charge when in combination therewith to achieve a greater output and efficiency as compared with spherical shock waves and particle velocities from a conventional detonator.

1 Claim, 7 Drawing Sheets

OMNI-DIRECTIONAL DETONATOR

DEDICATORY CLAUSE

The invention described herein may be manufactured, used, and licensed by or for the Government for governmental purposes without the payment to me of any royalties thereon.

BACKGROUND OF THE INVENTION

A prior joint invention of applicant, issued as U.S. Pat. No. 4,896,609 on Jan. 30, 1990, is assigned to United States of America as represented by the Secretary of the Army. This patent titled: "Planar Shock Wave Generator and Enhancer Device", achieved more efficiency to permit a change in design weight, length, and diameter for detonators used in warheads or other devices where space limitation was a consideration and where a higher closing rate for the resultant shock waves and their intersecting surfaces are required to close at even at a higher rate. This explosive planar shock wave generator produces a planar wave that travels down a shape charge cone to give amplified force on the jet. In all embodiments radial waves are converted to planar waves which react with an explosive shape charge. A planar wave shaper is comprised of a conical shaped planar charge having a predetermined diameter at the base and slant heights terminating at an apex. A cylindrically shaped fast detonating charge that is positioned above the cone shaped planar charge is detonated by a detonator positioned on the surface of the intersecting along the base of the conical shaped planar charge receive the planar shock wave as transformed by the conical shaped planar charge. An additional explosive charge which has intersecting surfaces with the faster cylindrically shaped detonating charge and the slower cone shaped detonating shape charge functions to direct the resultant shock wave inward at a perpendicular angle to the cone angles of the slower cone shaped detonating shape charge. This function results in a faster closing of the intersecting surfaces to yield a higher jet velocity directed along the center of the cone. Another embodiment provides for a shape of a slower cone shaped detonating shape charge to converge to an apex beneath the base of the conical shaped planar charge. The additional explosive charge for this embodiment results in directing the resultant shock wave inward at a more perpendicular angle which causes the intersecting surfaces to close at even a higher rate. This high closing rate results in a higher jet velocity and more efficiency to permit a reduction in overall weight, length, and diameter of the shape charge to achieve the same effect. If a greater resultant force is needed a larger diameter can be employed without an increase in length which is advantageous where lengths restriction to a warhead is a factor.

An object of this invention is to provide a design in the donor detonator charge wherein the output is greater than the output of spherical shock wave and the particle velocities from a conventional detonator.

Another object of this invention is to provide a donor detonator charge which will provide a better performance when employed in a safe and arm device.

SUMMARY OF THE INVENTION

The design of the donor detonator charge of this invention achieves improvement of the detonator's performance. The design causes both formation of particles from the donor charge case and the explosive force to be enhanced in a specific direction. Since the design of the case of the donor detonator charge is a fluted design, the specific direction of the outputs of the shock and particle velocities at the tips of the jets are greater than the output from a conventionally designed case of a donor detonator charge. A conventionally designed donor charge case has a cylindrical design. Upon activation of this donor charge the subsequently activated shock front and particles both follow a single, generally spherical shaped pattern. The term fluted as applied to the design of the donor charge detonator can be envisioned as a cylindrical shape that has been modified such as a fluted column wherein a plurality of channels, grooves, or furrows have been formed to include a valley portion separated by peaks between successive grooves. When the fluted design donor charge detonator is activated the explosive force follows along the valleys of the flutes thereby forming a plurality of jets similar to linear shape charge lines. The fluted detonator has a higher magnitude of shock at the points of flutes because of the jet effect caused by the fluted design configuration.

DESCRIPTION OF THE PREFERRED EMBODIMENT(S)

Figure 1:
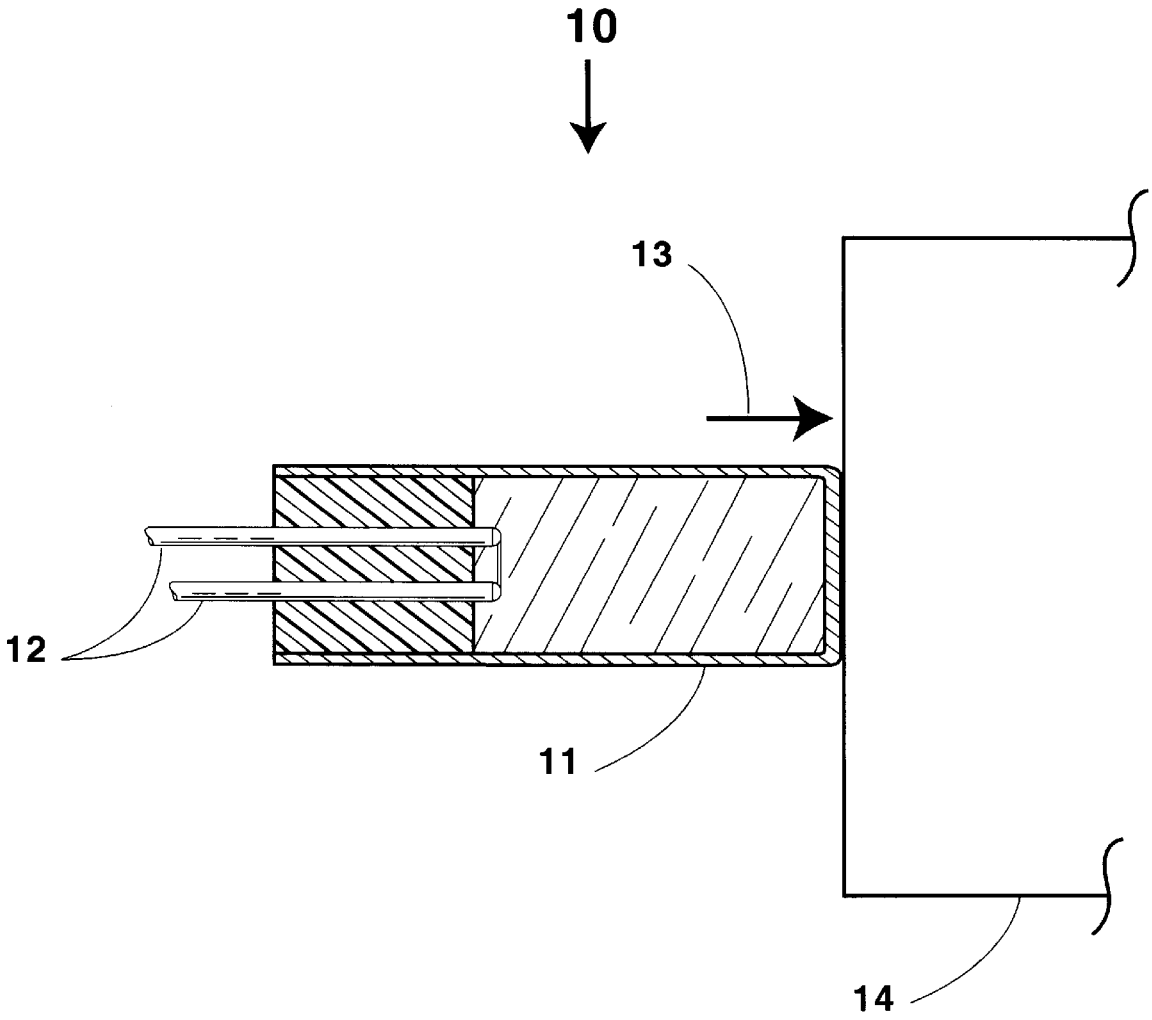
FIG. 1 PRIOR ART
FIG. 1 depicts a conventional prior art donor detonator charge with end on alignment to main charge or acceptor charge.
Figure 2:
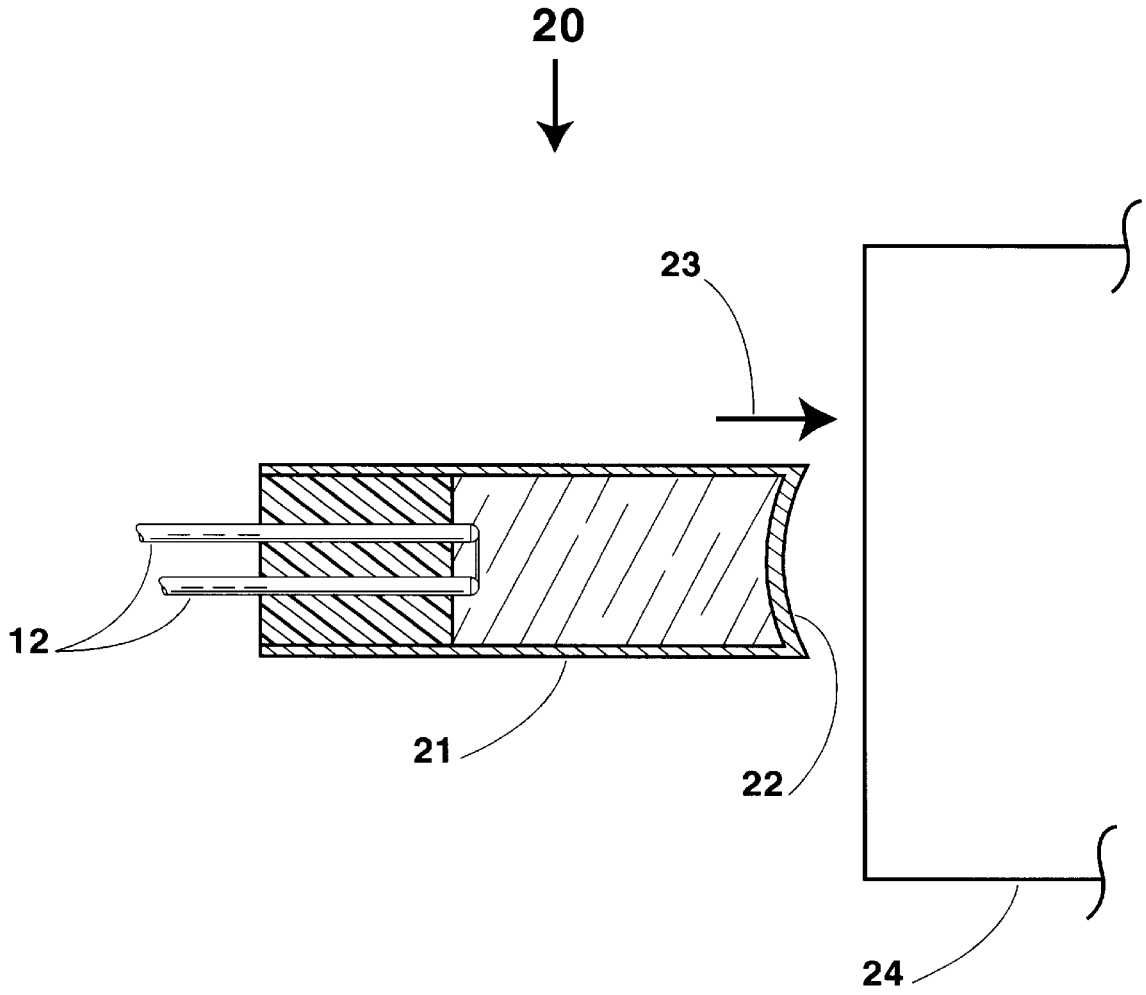
FIG. 2 PRIOR ART
FIG. 2 depicts a conventional prior art donor detonator charge with end on alignment to main charge or acceptor charge wherein a shaped end is shown which gives jet to improve linerar shock.
Figure 3:
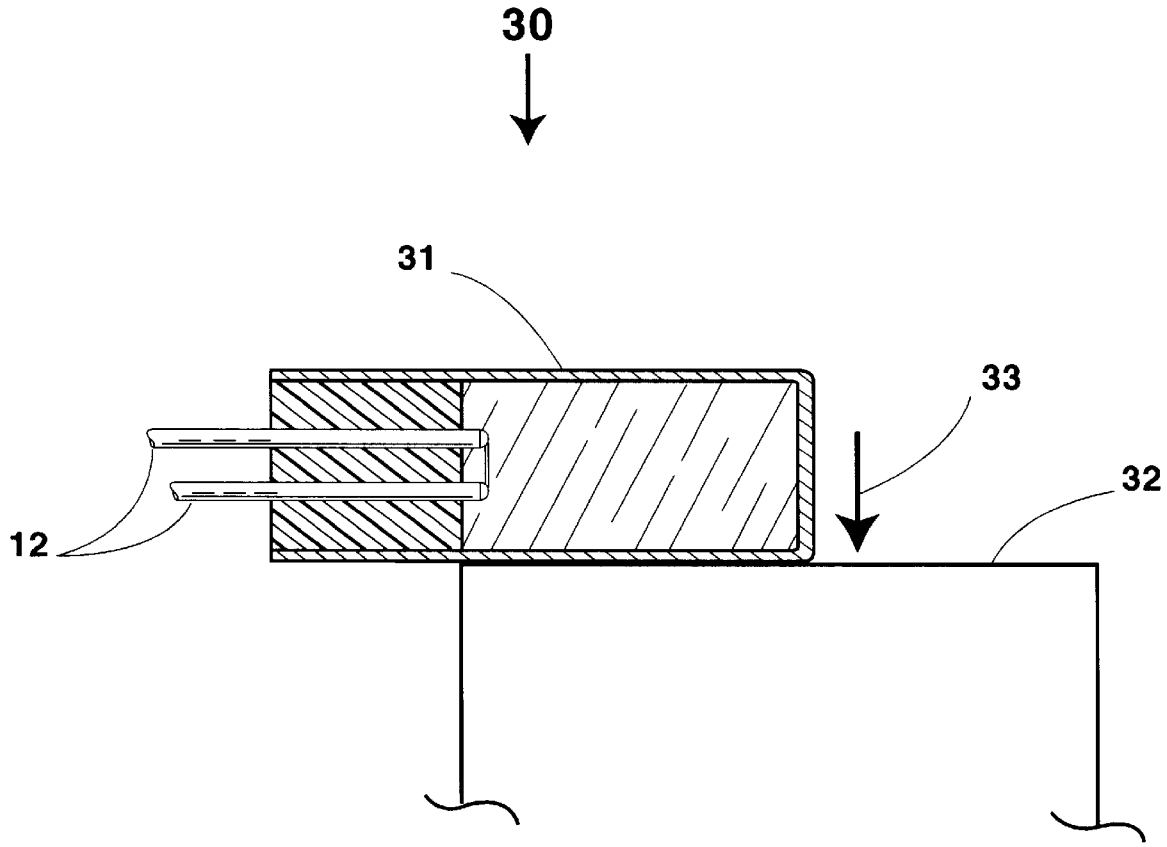
FIG. 3 PRIOR ART
FIG. 3 depicts a conventional prior art donor detonator charge with side on alignment to main charge or acceptor charge.
Figure 4:
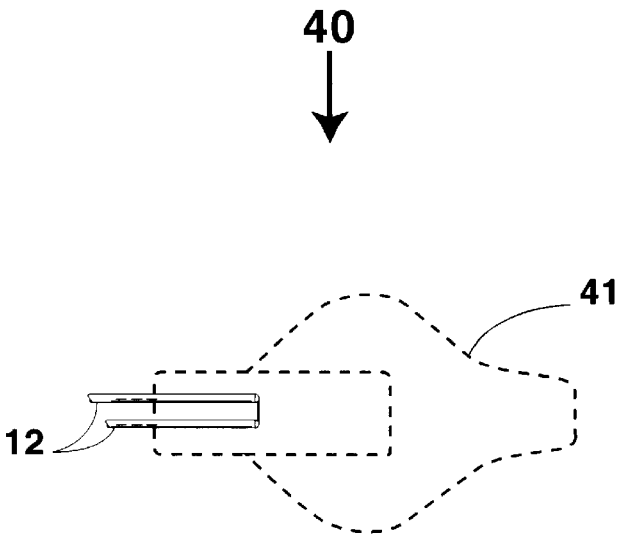
FIG. 4 PRIOR ART
FIG. 4 illustrates, side view, at detonation the shock and metal particles and the greatest directional shock pattern of the prior art donor detonator charge of FIG. 1.
Figure 5:
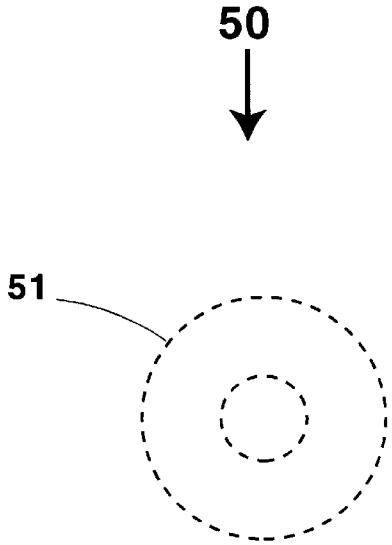
FIG. 5 PRIOR ART
FIG. 5 illustrates, end view, at detonation the shock and metal particles and the greatest directional shock pattern of the prior art donor detonator charge of FIG. 1.

In further reference to the Figures of the Drawing, FIG. 1, FIG. 2, and FIG. 3 depict conventional prior art detonator systems, respectively, 10, 20, and 30. FIG. 4, and FIG. 5 depict conventional prior art detonator systems after detonation to illustrate typical shock and debris pattern as viewed from a side view and end view respectively. FIG. 1, conventional prior art detonator system 10 is comprised of a donar charge 11 and a pair of electrical conductors 12 and a main charge or acceptor charge 14. The transfer of shock force with illustrated end on alignment of donor charge and acceptor charge is most efficient in a linear direction 13. FIG. 2, conventional prior art detonator system 20 is comprised of a donar charge 21 and a main charge or acceptor charge 24. The transfer of shock force with illustrated alignment of donor charge and acceptor charge is most efficient in linear direction 23. The shaped end 22 of donor charge give jet to improve linear shock in linear direction 23.

FIG. 3, conventional prior art detonator system 30 is comprised of a donar charge 31 and a main charge or acceptor charge 32. The transfer of shock force with illustrated side on alignment of donor charge and acceptor charge is less effective in a direction 33 than the end on alignment which is most efficient in a linear direction 13.

FIG. 4 depicts a conventional donor charge 40 after detonation with a shock and debris pattern 41 typically seen in a side view perspective.

FIG. 5 depicts a conventional donor charge 50 after detonation with a shock and debris pattern 51 typically seen in an end view perspective.

Having shown FIG. 1–FIG. 3 to illustrate prior art detonator systems 10, 20, and 30, and the shock and debris patterns 41 and 51 of FIG. 4 and FIG. 5, one skilled in the art can now be in a better position to fully appreciate the improved detonator donor charge. This improved detonator donor charge design is a fluted design. This improved fluted donor charge design can be employed as illustrated in a donor charge-acceptor charge relationship as illustrated in FIG. 1–FIG. 3.

Figure 6:
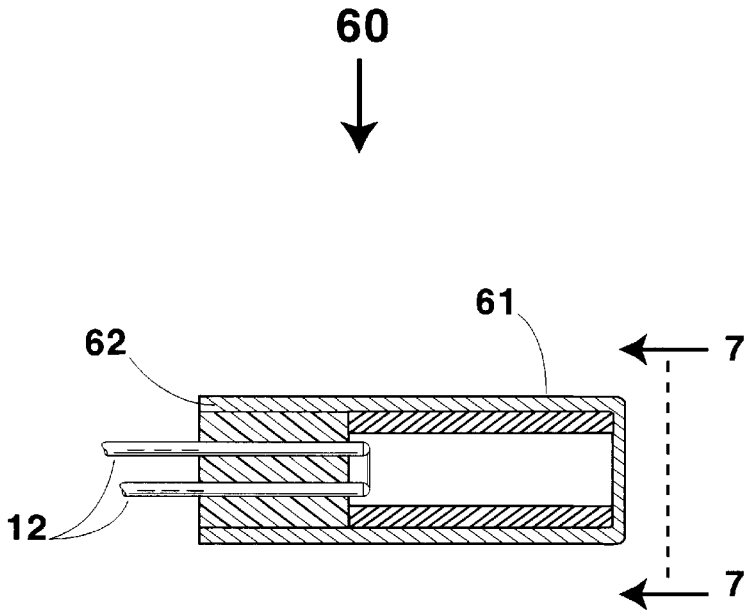
FIG. 6 depicts an improved fluted design of a donor detonator charge.

FIG. 6 depicts a donor charge 60 which comprises a fluted case 61 having valleys 62. In the environment of use, when the explosive is activated the valleys of the flutes form jets similar to linear shape charge lines. The shock and particle velocity at the tips of the jets are greater than the spherical shock and particle velocity from a conventional detonator.

Figure 7:
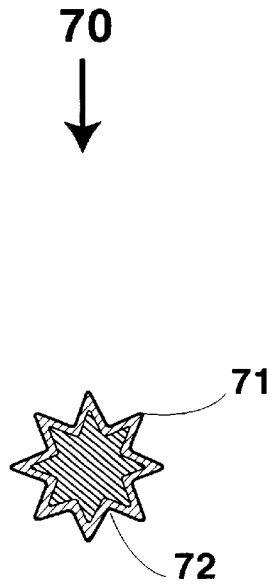
FIG. 7 depicts an end view of the fluted design donor detonator charge of FIG. 6, along line 7—7 of FIG. 6.

FIG. 7 depicts an end view of the fluted design donor detonator charge 70 of FIG. 6, along line 7—7 of FIG. 6. This view shows the valleys 62 of the flutes which form jets similar to linear shape charge lines. The shock and particle velocity at the tips of the jets 71 are greater than a spherical shock and particle velocity from a conventional detonator as illustrated in FIG. 5.

Figure 8:
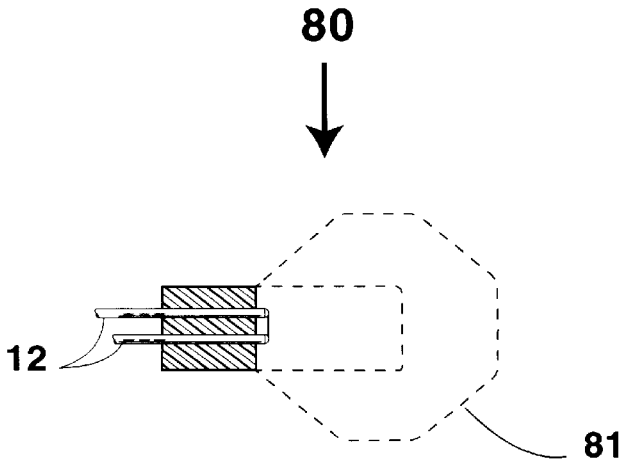
FIG. 8 illustrates, end view, at detonation the shaped front of the stronger shock and higher velocity particles ejected radially along the jets of the improved fluted design of the donor detonator charge.

FIG. 8 depicts a side view 80 at detonation of the improved fluted detonator to show the shock and debris in a radial pattern 81 as would be seen from this perspective.

Figure 9:
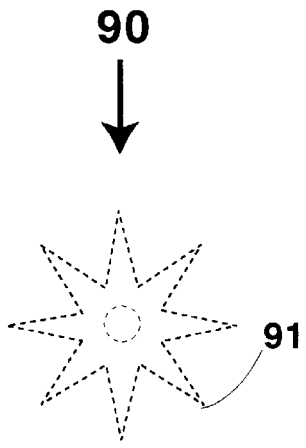
FIG. 9 depicts the fluted design donor detonator charge at detonation to illustrate typical shock and debris patterns as viewed from end.

FIG. 9 depicts an end view 90 at detonation of the improved fluted detonator to show the shaped front 91 which illustrates a stronger shock and higher velocity as would be seen from this perspective which shows the particles projected in a radial pattern.

Figure 10:
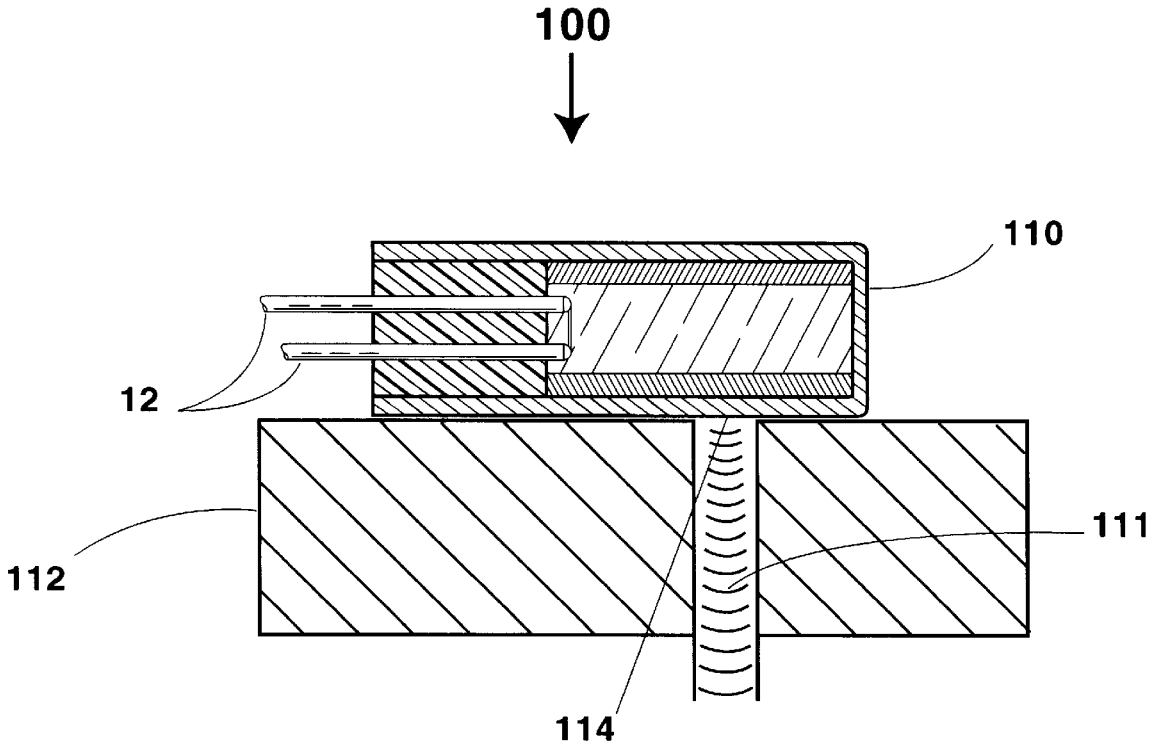
FIG. 10 depicts a safe and arm device configuration which comprises a fluted detonator donor charge with side alignment to an explosive charge acceptor.

FIG. 10 depicts a safe and arm device 100 which employs a fluted detonator donor charge 110 in a side alignment relationship with an explosive acceptor charge 111 which is housed in a metal housing 112. Shock is transferred at a higher magnitude of shock because of the jet effect of the fluted configuration from the fluted detonator donor charge to the point 114 on the explosive acceptor charge.

I claim:

1. A donor charge detonator comprising:

i. a donor charge case for containing a main charge of explosive with mean for initiating said main charge of explosive, said donor charge case having a generally cylindrical shape; and, ii. a plurality of flutes formed around the outer surface of said case, said plurality of flutes having valley members or grooves separated by peaks between successive grooves, said plurality of flutes functioning after initiation of said main charge of explosive to cause the formation of particles from said donor charge case and the resulting explosive force to follow along the valleys of the flutes thereby forming a plurality of jets similar to linear charge lines whereby the resultant shock is enhanced in a specific direction, said resulting force and resultant shock transferred at a higher magnitude because of the jet effect of the fluted configuration of said donor charge case, said specific direction being directed to a point on an explosive acceptor charge when in combination therewith to achieve a greater output and efficiency as compared with spherical shock waves and the particle velocities from a conventional detonator.

* * * * *